United States Patent [19]

Khri-Yakub et al.

[11] Patent Number: 4,959,674

[45] Date of Patent: Sep. 25, 1990

[54] ACOUSTIC INK PRINTHEAD HAVING REFLECTION COATING FOR IMPROVED INK DROP EJECTION CONTROL

[75] Inventors: Butrus T. Khri-Yakub; Scott A. Elrod, both of Palo Alto; Calvin F. Quate, Stanford, all of Calif.

[73] Assignee: Xerox Corporation, Stamford, Conn.

[21] Appl. No.: 416,796

[22] Filed: Oct. 3, 1989

[51] Int. Cl.[5] ..... B41V 2/04

[52] U.S. Cl. ..... 346/140 R; 310/335

[58] Field of Search ..... 346/140, 75; 310/335; 367/150; 181/176

[56] References Cited

U.S. PATENT DOCUMENTS

| | | | |
|---|---|---|---|
| 4,006,444 | 2/1977 | Quate et al. | 367/7 |
| 4,308,547 | 12/1981 | Lovelady et al. | 346/140 |
| 4,321,696 | 3/1982 | Kanda | 367/157 |
| 4,562,900 | 1/1986 | Anderson et al. | 181/176 |
| 4,697,195 | 9/1989 | Quate et al. | 346/140 |
| 4,719,476 | 1/1988 | Elrod et al. | 346/140 |
| 4,719,480 | 1/1988 | Elrod et al. | 346/140 |
| 4,751,529 | 6/1988 | Elrod et al. | 346/140 |
| 4,751,534 | 6/1988 | Elrod et al. | 346/140 |
| 4,782,350 | 11/1988 | Smith et al. | 346/140 |

*Primary Examiner*—Joseph W. Hartary

*Attorney, Agent, or Firm*—Jonathan A. Small

[57] ABSTRACT

An acoustic ink printhead having improved ink drop ejection control includes a substrate having an array of acoustic lenses at its upper surface for bringing rf acoustic waves to a predetermined focus and a layer of acoustically reflective material of a thickness equal to an odd multiple of one quarter of the wavelength of the acoustic rf waves passing through it having openings corresponding to and positioned above each lens. Ink from an ink pool is allowed to couple acoustically to the lenses at each opening for receiving the focussed acoustic rf wave, while the layer acoustically isolates the interstitial regions between each lens by reflecting the acoustic rf waves incident on the upper surface of the substrate in those regions.

14 Claims, 4 Drawing Sheets

ACOUSTIC INK PRINTHEAD HAVING REFLECTION COATING FOR IMPROVED INK DROP EJECTION CONTROL

BACKGROUND OF THE INVENTION

1. Field of the Invention

The present invention relates generally to acoustic ink printing, and more particularly to an improved printhead having an acoustic reflection coating applied thereon to reduce unwanted transmission of acoustic energy into an ink pool.

2. Description of the Prior Art

Acoustic ink printing is a method for transferring ink directly to a recording medium having several advantages over other direct printing methodologies. One important advantage is the lack of necessity for nozzles and ejection orifices that have caused many of the reliability (e.g., clogging) and picture element (i.e., "pixel") placement accuracy problems which conventional drop-on-demand and continuous-stream ink jet printers have experienced.

As is known, an acoustic beam exerts a radiation pressure against objects upon which it impinges. Thus, when an acoustic beam impinges on a free surface (e.g., liquid/air interface) of a pool of liquid from beneath, the radiation pressure which it exerts will cause disturbances on the surface of the pool. The radiation pressure may reach a sufficiently high level that the force of surface tension is overcome and individual droplets of liquid are ejected from the pool. Given sufficient energy, the droplets may eject at a sufficient velocity to reach a recording medium proximately located to the free surface of the pool.

Focussing the acoustic beam on or near the surface of the pool intensifies the radiation pressure it exerts for a given amount of acoustic power. In order to accomplish such focussing, acoustic lenses are commonly used. These lenses conveniently are essentially spherically shaped indentations located in a substrate through which the acoustic beam may travel. One or more such lenses may be disposed in a single substrate, and each of the lenses may be individually addressable. See, for example, commonly assigned U.S. Pat. Nos. 4,751,529, and 4,751,534, both to Elrod et al. and issued June 14, 1988, and commonly assigned application for U.S. patent Ser. No. 07/253,371, filed Sept. 30, 1988, by Elrod et al., each incorporated by reference herein, for further discussion of acoustic lens characteristics.

Referring now to FIG. 1, there is illustrated (in pertinent part) an acoustic ink printhead 10 of a design known in the art. Acoustic ink printhead 10 includes a body or substrate 12. An acoustic wave generating means 14, typically a planar transducer, for generating an acoustic wave of predetermined wavelength is positioned on a lower surface 16 of substrate 12. Lower (and the like) is used herein for convenience and no limitation on orientation is intended thereby. Transducer 14 is typically composed of a piezoelectric film (not shown), such as a zinc oxide (ZnO), which is sandwiched between a pair of electrodes (also not shown), or other suitable transducer composition such that it is capable of generating plane waves 18 (explicitly shown in FIG. 1 for illustration) in response to a modulated rf voltage applied across its electrodes. Transducer 14 will typically be in mechanical communication with substrate 12 in order to facilitate efficient transmission of the generated acoustic waves into the substrate.

Acoustic lens 20 is formed in the upper surface 22 of substrate 12 for focussing acoustic waves 18 incident on its convex side to a point of focus 24 on its concave side. Upper surface 22 as well as the concave side of acoustic lens 20, face a liquid pool 26 (preferably an ink pool) which is acoustically coupled to substrate 12 and acoustic lens 20. This acoustic coupling may be accomplished by placing the liquid of liquid pool 26 in physical contact with acoustic lens 20 and upper surface 22, or by introducing between the liquid of liquid pool 26 and acoustic lens 20 and upper surface 22 an intermediate acoustic coupling media (not shown). Such intermediate acoustic coupling media are discussed in the aforementioned U.S. Pat. Nos. 4,751,534 ("Planarized Printheads For Acoustic Printing") and in copending Application for U.S. patent Ser. No. 07/287,791, filed Dec. 21, 1988, both commonly assigned.

When a printhead is formed having adjacent acoustic lenses, especially when the adjacent lenses are individually addressable, care must be taken to accurately direct the acoustic beam to impinge as exclusively as possible on the desired lens. Some of the undesirable effects of the acoustic beam impinging elsewhere than on the desired lens are insufficient radiation pressure on the liquid surface, lens cross-talk, and generation of unwanted liquid surface disturbances. Each of these effects result in loss or degradation of droplet ejection control. The present invention primarily addresses the later effect—generation of liquid surface disturbances.

As graphically shown in FIG. 1, plane waves 18 diverge as they radiate through the substrate from transducer 14 to upper surface 22. This divergence is due to the effect of diffraction of the sound wave passing through the substrate, and is a function of the radius of the transducer 14, of the thickness of the substrate, and of the wavelength of the wave passing through the medium. (It is generally assumed that the interface between substrate 12 and transducer 14 is ideal, so that consideration need not be given to the refractive effects of the wave passing from one medium to another, and further that transducer 14 generates a perfect plane wave.) The result of this divergence is to limit the center-to-center distance between adjacent lenses (if lenses are too closely spaced the diverging energy from one lens may impact an adjacent lens) and to cause energy to impinge upper surface 22 outside of lens 20 which may be imparted in the form of acoustic waves (not shown) into liquid pool 26.

Focus point 24, at or very near free surface 28, is the point of greatest concentrated energy for causing the release of droplet 30. Thus, by positioning the focus point 24 at free surface 28, the energy required to eject a droplet is minimized. However, focus point 24 is preset for each lens by the lens diameter, shape, etc. In order to maintain focus point 24 at or very near free surface 28, it is therefore important to maintain free surface 28 at a predetermined height above substrate 12.

As mentioned, one effect of illumination of surface 22 is transmission of radiant energy from substrate 12 to liquid pool 26. The radiant energy is transmitted through the liquid of liquid pool 26 striking free surface 28, thereby generating surface disturbances on free surface 28. These surface disturbances are transmitted along free surface 28 in the form of surface waves (not shown) which effect free surface 28 in regions directly above lens 20. In those cases where an array of lenses are used, the surface waves affect free surface 22 in regions above one or more acoustic lenses. The surface waves on free surface 28 result in deviation of free surface 28 from planar and from a preferred height, thereby altering the location of free surface 28 relative to fixed focus point 24, resulting in degradation of droplet ejection (i.e., print) control.

The result of free surface 28 deviating from planarity is varying angle of droplet ejection. Droplets will tend to eject in a direction normal to free surface 28. For optimum control of placement of the drop on the recording medium with the minimum amount of required acoustic energy, it is desired to maintain ejection angle of the drop at a predetermined valued, generally perpendicular to the local angle of the surface of the recording medium. Therefore, attempts are made to maintain free surface 28 parallel to the primary surface of the recording medium. Surface disturbances will vary the local surface angle of the liquid pool, especially over the acoustic lenses. This results is drop ejection at varying angles with consequent loss of printing accuracy and efficiency.

The result of free surface 28 varying from a preferred height is an increase in the energy required to cause droplet ejection and an adverse effect on droplet size and droplet ejection direction control. In fact, surface height must be maintained with a great deal of accuracy since acoustic waves entering liquid pool 26 will also reflect at free surface 28 resulting in coherent interference between the reflected and unreflected waves. The boundary conditions on free surface 28 for resonant constructive interference and anti-resonant destructive interference differ from each other by only one quarter wavelength. The effect of constructive interference is to exacerbate the surface disturbing effects of energy transmitted into liquid pool 26 outside lens 20.

Although it is possible that transducer size may be selected such that illumination outside lens 20 is minimized, changing transducer size impacts divergence of the wave in the substrate. For example, acoustic wave divergence effectively begins in a material after the distance d defined as $$d=R^2/\lambda \quad (1)$$

where R is the radius of the transducer and $$\lambda=v_m/f \quad (2)$$

where $v_m$ is the velocity of sound in the material, and f is the frequency of the sound wave. If the transducer radius is decreased in order to reduce the size of the cone of divergence, the distance d from the transducer at which the divergence of the acoustic waves begins will be reduced. If the substrate thickness remains unchanged, decreasing transducer size (and hence reducing d) results in greater divergence. Thus, reducing the transducer size implies a reduction in substrate thickness. However, the thickness of the substrate is limited by its ability to support itself without cracking. This minimum thickness is on the order of 0.5–2 mm, and effectively limits the transducer size.

Similarly, it is possible to increase the radius of the acoustic lenses such that the diverging acoustic waves impinge fully on the lens. Typically, however, lens-to-lens spacing is much larger than the printed spot size. Thus, an array of lenses in staggered rows is often used for single pass printing. The result of increasing the center-to-center spacing is an increase in the number of staggered rows for a fixed print resolution. This is not desirable since it means that the printhead size (i.e., substrate size) and cost will both increase. Thus, this is also not an optimal solution.

Presently there is an unaddressed need in the art for improved performance of acoustic ink printing mechanisms. Specifically, there is a need in the art for a method and apparatus for minimizing surface disturbances at the free surface of the ink pool above one or more acoustic lenses. The invention described and contained herein addresses this and related needs in the art.

SUMMARY OF THE INVENTION

The present invention provides an improved printhead for acoustic ink printing. The printhead is of the type having one or more acoustic radiators for radiating a free surface of a pool of liquid, typically ink, with a corresponding number of focused acoustic beams and being characterized by having a predetermined overcoating for inhibiting extraneous acoustic energy from coupling into the liquid peripherally of the beam or beams.

Specifically, the improved acoustic ink printhead according to this invention includes:

a solid substrate having a first, or upper surface with generally spherically shaped indentations formed therein to define acoustic lenses, and a second, or lower surface opposite the upper surface;

transducer means intimately coupled to the lower surface of the substrate for generating rf acoustic waves to illuminate the lenses such that the lenses launch respective converging acoustic beams into the liquid; and acoustically reflective means intimately coupled to and substantially entirely overlaying the upper surface of the substrate except above the lenses wherein openings above each of the lenses are defined, for inhibiting extraneous acoustic energy from coupling into liquid of a liquid pool above the upper surface other than at the lenses.

According to one aspect of the invention, the coating material will have a relatively high acoustic impedance as compared to the material from which the substrate is formed. To this end, gold has been shown to have desirable properties as a reflective material.

According to another aspect of the invention, the coating will be of a predetermined thickness, preferably equal to one-quarter of the wavelength of the acoustic waves passing through it. However, the coating may be of other thicknesses, preferably equal to odd multiples of one-quarter of the wavelength of the acoustic waves passing through it.

A fuller understanding of the invention may be had by referring to the following description and claims taken in conjunction with the accompanying drawings.

DETAILED DESCRIPTION OF THE PREFERRED EMBODIMENTS

Figure 1:
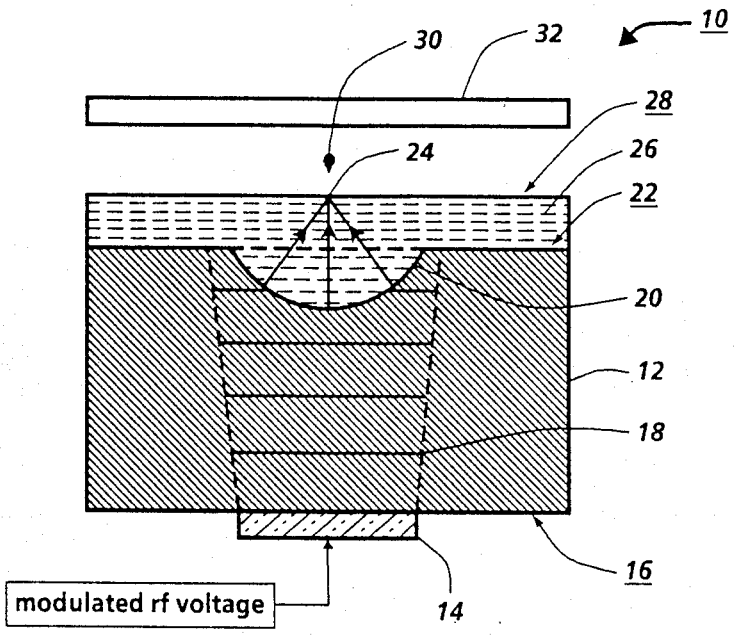
Fig. 1 Prior Art
FIG. 1 shows an acoustic ink printhead of a design known in the art.
Figure 2:
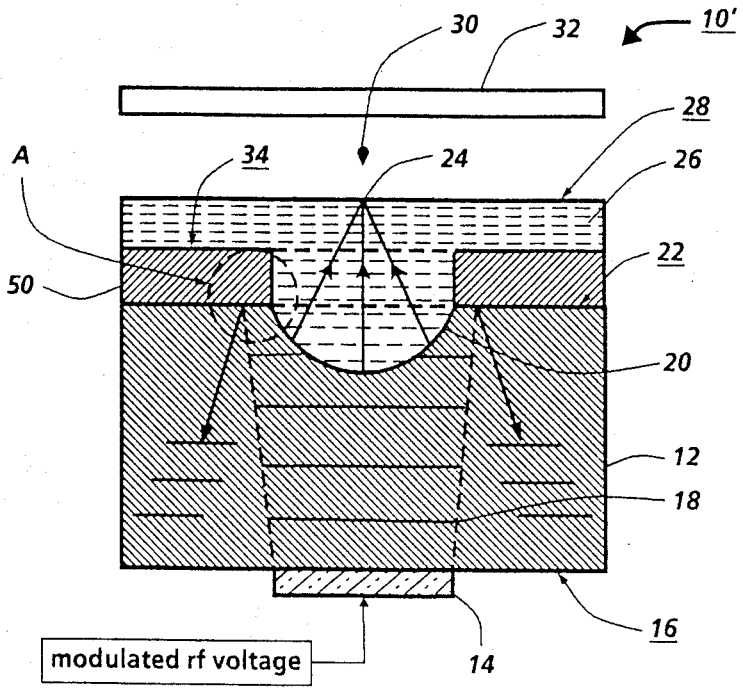
FIG. 2 shows an acoustic ink printhead according to one embodiment of the present invention.

Referring now to FIG. 2, there is shown a printhead 10′ according to a preferred embodiment of the present invention. As with printhead 10 described with reference to FIG. 1, printhead 10′ includes a substrate 12, with an acoustic lens 20 formed therein. In general, as between FIGS. 1 and 2 herein, like elements are numbered with like reference numerals and the description of each is similar except where otherwise noted.

With reference to FIG. 2, an isolation layer 50 of acoustically reflective material is introduced which overlays the entirety of, and is preferably in mechanical communication with, upper surface 22, except in the region over lens 20. Isolation layer 50 will thus reside between upper surface 22 and liquid pool 26, except for the regions above lens 20, wherein the liquid of liquid pool 26 is acoustically coupled to substrate 12 by direct physical contact or by communication through an intermediate layer (not shown) of acoustically transmissive material. Through proper placement and selection of certain desirable characteristics, isolation layer 50 serves to acoustically isolate substrate 12 and liquid pool 26 except in the region of lens 20.

Material selected for isolation layer 50 should exhibit the following desirable characteristics for the reasons enumerated below.

Figure 3:
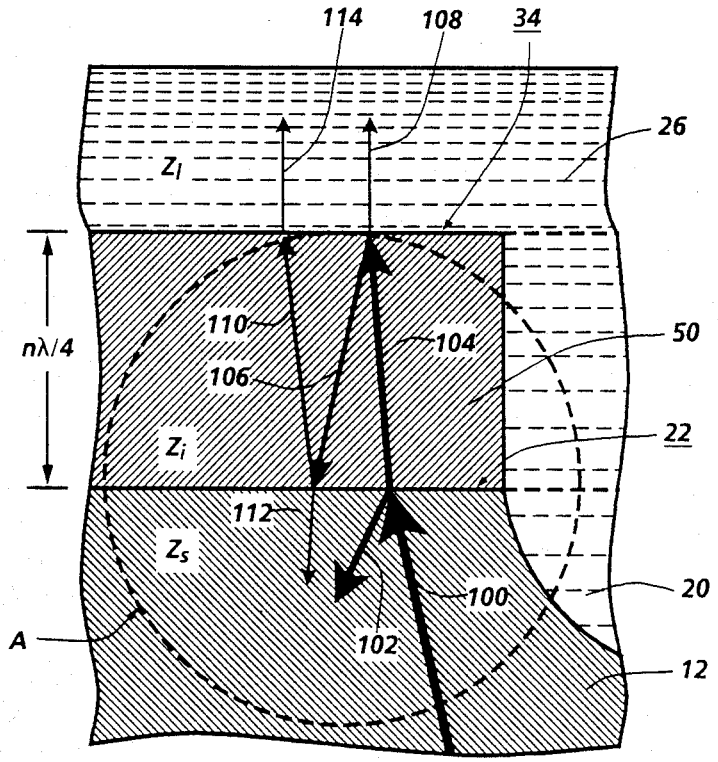
FIG. 3 schematically illustrates the transmission and reflection of acoustic waves in various levels of the embodiment of the present invention as shown in FIG. 2.

(1) The selected isolation layer material must have a much greater acoustic impedance ($Z_i$) than the acoustic impedance of the substrate ($Z_s$). If there is a poor match between the acoustic impedances of two materials, transmission of acoustic energy between the two materials is inhibited. Reference should be made to FIG. 3, showing in greater detail region A of FIG. 2, which graphically illustrates this effect. The impedance mismatch between substrate 12 and isolation layer 50 will cause attenuation of much of the transmitted energy outside of the region above lens 20 by reflecting a portion of the acoustic energy (represented by arrow 102) of the total incident acoustic energy (represented by arrow 100) at upper surface 22. However, some energy will overcome the impedance mismatch and be transmitted in the form of acoustic waves into isolation layer 50 (represented by arrow 104). Thus, when $Z_i >> Z_s$, most of the acoustic energy incident upon upper surface 22 from transducer 14 is reflected at the isolation layer/substrate interface, and only a small amount of that incident energy is transmitted from substrate 12 to isolation layer 50 and, in turn, available to be transmitted to liquid pool 26.

(2) The selected isolation layer material must have a much greater acoustic impedance ($Z_i$) than the acoustic impedance ($Z_l$) of the liquid of liquid pool 26. Similar to (1) above, the impedance mismatching will cause attenuation of the transmitted energy outside of acoustic lens 20. Acoustic energy (104) incident upon the interface between the isolation layer and the liquid pool will primarily be reflected as acoustic waves (represented by arrow 106) due to the impedance mismatch between the isolation layer and the liquid. Only a relatively small portion of the acoustic energy (represented by arrow 108) transmitted to isolation layer 50 will be transmitted into liquid pool 26. Thus, when $Z_i >> Z_l$ transmission of acoustic energy to liquid pool 26 is even further reduced to an acceptable level.

(3) The thickness of isolation layer 50 should be equal to an odd integer multiple of one-quarter of the wavelength ($n\lambda/4$, $n=1, 3, 5, \ldots$) of the acoustic waves traveling through it. By selecting the thickness of isolation layer 50 as one-quarter of, or odd multiples thereof, the wavelength of the acoustic waves therein, the transmitted waves (108) at interface 34 are 180° out of phase of the transmitted waves (114) entering the liquid after one round-trip propogation (i.e., internal reflection) in isolation layer 50. Once a steady-state is reached, waves (108) and (114) will add destructively, effectively canceling each other out and resulting in a minimum of signal transmission into liquid 26.

There are three secondary considerations for selection of a material for isolation layer 50 which simplify the process of depositing and patterning the layer and which ensure longevity of the printhead formed according to the present invention, respectively. They are:

(1) Selecting a material which can be deposited by known deposition techniques;

(2) Selecting a material which is compatible with known photolithographic techniques; and (3) Selecting a material which is highly resistant to the corrosive environment of submersion in a liquid pool (such as an ink pool).

Given each of the above-enumerated primary and secondary considerations, it has been found that gold is a very satisfactory material for use as an isolation layer. Other materials which satisfy the above criteria are, however, contemplated within the scope of the present invention.

In order to produce the acoustic waves discussed above, transducer 14 is driven by an AC signal modulated at either a single frequency or a broad bandwidth of frequencies. The selection of the modulating frequency or frequencies is governed by several considerations. Primarily, drop size will be determinative. For a discussion of variations of drop size base on frequency see U.S. patent application Ser. No. 07/376,191, filed June 30, 1989, entitled Variable Spot Size Acoustic Printing, assigned to the assignee of the present invention and incorporated herein by reference.

As mentioned above, acoustic waves will pass through a substrate, having an acoustic impedance $Z_s$ and a liquid pool, the liquid in which having an acoustic impedance $Z_l$. For such a system it is possible to plot power transmitted through the liquid of the liquid pool as a function of the frequency of the acoustic waves. That is, it is possible to determine what amount of energy emitted from a transducer passes through both the substrate and the liquid pool and ultimately impinges upon the free surface of the liquid pool. Such a plot is shown in FIG. 4*b*, which shows insertion loss at free surface 428 of liquid pool 426 versus operating frequency for the system of FIG. 4*a* consisting of a zinc oxide transducer 414 exposed to air on one side and in mechanical communication with a silicon substrate 412 on the other. In FIG. 4*b*, $$\text{Loss} = -20 \log (P_{out}/P_{in}) \quad (3)$$

where $P_{out}$ is power out of the liquid pool and $P_{in}$ is power into the substrate, respectively. The point of minimum insertion loss, approximately 200.4 MHz for the system of FIG. 4a, corresponds to the particular choice of transducer and substrate materials, size and relationship. The plot of FIG. 4b demonstrates that the system of FIG. 4a will operate with greater efficiency at certain frequencies than at other frequencies.

Figure 4A:
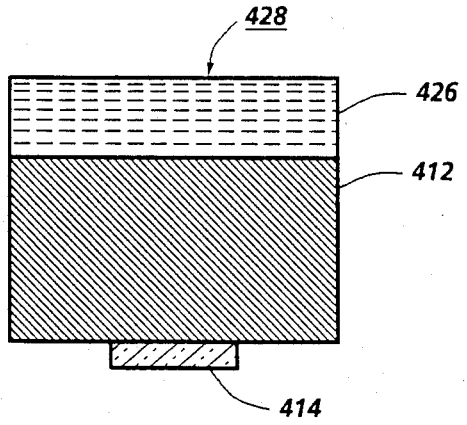
FIG. 4*a* is an illustration of a test structure.
Figure 4B:
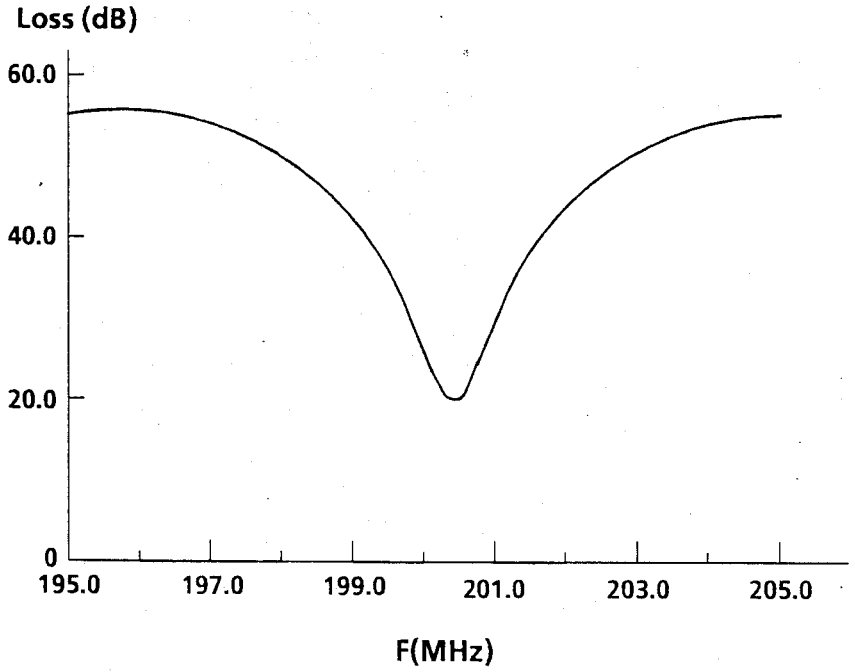
FIG. 4*b* is a plot of frequency versus insertion loss for the structure of FIG. 4*a*, illustrating determination of optimum operating frequency.
Figure 5A:
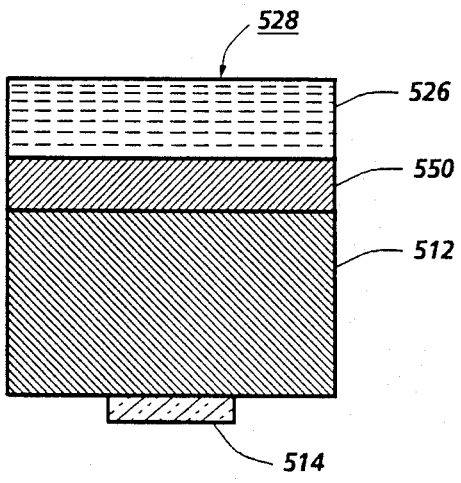
FIG. 5*a* is an illustration of a test structure having a gold coating applied thereto.
Figure 5B:
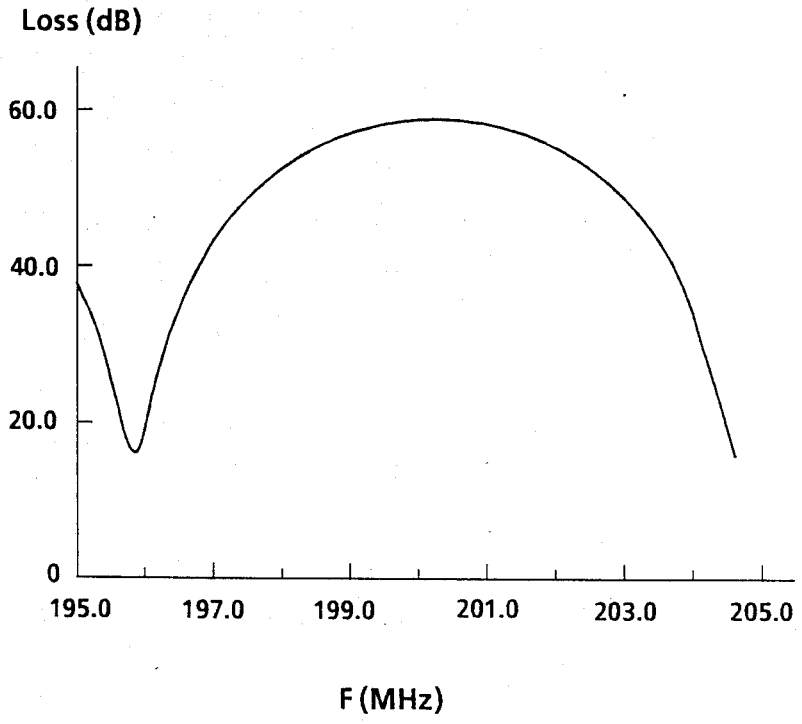
FIG. 5*b* is a plot of frequency versus insertion loss for the structure of FIG. 5*a*, illustrating the effects of a gold coating.

A similar plot of loss versus frequency for the system of FIG. 5a, including substrate 512, transducer 514 and liquid pool 526 identical to that of FIG. 4a and further including a gold isolation layer 550 is shown in FIG. 5b. It is demonstrated in FIG. 5b that loss has been increased at and around the frequency of lowest loss in the system of FIG. 4a (i.e., a system without isolation layer 550). In fact, for the system of FIG. 5a where gold isolation layer 550 has been chosen as one-quarter of the wavelength corresponding to the frequency of minimum loss shown in FIG. 4b, the frequency of relative maximum loss for the system of FIG. 5a is the same as the frequency of relative minimum loss for the system of FIG. 4a. This is the result of the destructive combining of acoustic waves discussed above. Thus, by choosing an operating frequency based on a plot such as that shown in FIG. 4b, then choosing an isolation layer thickness of one-quarter of the wavelength corresponding to that frequency, loss will be maximized (i.e., transmission of energy from the substrate into the liquid pool will be minimized).

It will be noted that printheads according to the present invention will include both uncoated regions (in alignment with the apertures of the acoustic lenses) and coated regions (in the interstitial or peripheral regions between the acoustic lenses). Thus, optimum operating frequency for such a system may be chosen by first picking the type of transducer used, and the resolution (and hence drop size) desired. This will determine what the theoretical operating frequency should be. The acoustic lens system without the isolation layer can then be modeled, resulting in plots of insertion loss as a function of frequency, such as shown in FIG. 4b. From such a plot the actual optimum operating frequency can determined, which in turn will yield the value of $\lambda/4$ (the thickness of isolation layer 50).

In the ideal case acoustic lenses would be driven at a single frequency. However, experience has shown it to be preferable to drive the lenses with a broad bandwidth frequency spectrum based on several factors. Such factors include nonplanarity of upper surface 22, substrate 12 being of varying thickness, etc. In each of these cases, insertion loss versus frequency calculated at various points across the transducer will differ. Furthermore, as mentioned, the lenses are very sensitive to variations in the height of liquid pool 26. Experience has also shown that it is not practicable to drive each lens of an array of lenses by its own AC voltage supply (based on cost, size, etc.) Since each AC voltage supply will be required to power more than one acoustic lens it may not be possible to operate each voltage supply at the single optimum operating frequency of each lens. According to a preferred embodiment of the present invention, these difficulties are overcome by operating the AC voltage sources at a broad bandwidth frequency spectrum within a preselected range. In certain embodiments a broad bandwidth spectrum is applied in order to overcome irregularities in transducer geometries. In such embodiments, the bandwidth is selected to be wide enough to cover all the optimum frequencies for all lenses. For a discussion of generation of a broad bandwidth signal see U.S. patent application Ser. No. 07/287,791, filed Dec. 21, 1988, assigned to the assignee of the present invention and incorporated herein by reference.

The thickness for isolation layer 50 in the case of operation of the voltage supplies at a broad spectrum can be chosen such that the center frequency of the spectrum has the maximum loss as shown in FIG. 5b. However, thickness is somewhat less crucial in the broadband case. In such a case the reduction in transmission of the acoustic signal from surface 22 is not as large as it is in the single frequency case. This is because, as evidenced in FIG. 5b, there are frequencies around the center frequency at which there is small loss for the transmission of the acoustic energy. The signal in the case of the structure with isolation layer 50 is attenuated for a larger band of frequencies compared to the case of the structure without isolation layer 50, resulting in larger overall loss for the entire spectrum of input frequencies with a reasonable amount of latitude in the selection of the thickness of isolation layer 50.

While the invention has been described in conjunction with a specific embodiment, it will be evident to those skilled in the art that many alternatives, modifications and variations will be apparent in light of the foregoing description. For example, a printhead according to the present invention has been described which includes a substrate, a transducer and a single reflective coating. It will be evident from the above, however, that two or more layers of reflective coating having the above-described attributes may be used to further reduce transmission of energy into the liquid pool outside of the acoustic lenses.

Furthermore, although typical acoustic ink printers will include one or more planar transducers and acoustic lenses located on and in a substrate, as discussed above, significant alternatives exist in the art. For example, such an alternative is use of piezoelectric shell transducers, such as described in U.S. patent Ser. No. 4,308,547, issued to Lovelady et al. on Dec. 29, 1981. It will be understood that the scope of the present invention is such as to apply to these and other alternatives, as well as that described above, without need for extraordinary skill in the art. Accordingly, the invention is intended to embrace all such alternatives, modifications and variations as fall within the spirit and scope of the appended claims.

What is claimed is:

1. An acoustic printhead for ejecting droplets of liquid on demand from a free surface of a liquid pool, comprising:

a solid substrate having first and second surfaces, and having an acoustic focussing element formed therein;

acoustic wave generating means intimately coupled to said second surface of said substrate for generating rf acoustic waves to illuminate said lens such that said lens launches converging acoustic beams into said liquid; and acoustically reflective means intimately coupled to and substantially entirely coating said first surface of said substrate except in the region proximate said acoustic lens such as to define an opening corresponding to the position and size of said acoustic lens, for inhibiting extraneous acoustic energy from coupling into the liquid pool other than through said lens.

2. The printhead of claim 1, wherein said substrate has a first acoustic impedance and said acoustically reflective means has a second acoustic impedance greater than said first acoustic impedance.

3. The printhead of claim 2, wherein said acoustic wave generating means generates rf acoustic waves of a predetermined frequency and wavelength and further wherein said acoustically reflective means is of a thickness equal to one quarter of the wavelength of a selected one of said generated rf acoustic waves.

4. The printhead of claim 2, wherein said acoustic wave generating means generates rf acoustic waves of a predetermined frequency and wavelength and further wherein said acoustically reflective means is of a thickness equal to an odd multiple of one quarter of the wavelength of a selected one of said generated rf acoustic waves.

5. The printhead of claim 2, wherein said acoustically reflective means is comprised substantially exclusively of gold.

6. The printhead of clam 1, wherein said acoustic focussing element is a generally spherically shaped indentation located in said first surface of said substrate.

7. An acoustic printhead for ejecting droplets of liquid on demand from a free surface of a liquid pool, comprising:

a solid substrate having a first surface with a generally spherically shaped indentation formed therein to define an acoustic lens, and second surface opposite said first surface, said substrate having a first acoustic impedance;

acoustic wave generating means intimately coupled to said second surface of said substrate for generating rf acoustic waves of a predetermined wavelength to illuminate said lens such that said lens launches converging acoustic beams into said liquid; and acoustically reflective means of a thickness equal to an odd multiple of one quarter of the wavelength of a selected one of said generated acoustic waves, intimately coupled to and substantially entirely coating said first surface of said substrate except in the region proximate said acoustic lens such as to define an opening corresponding to the position and size of said acoustic lens, said acoustically reflective means having a second acoustic impedance greater than said first acoustic impedance, for inhibiting extraneous acoustic energy from coupling into the liquid pool other than through said lens.

8. An acoustic printhead for ejecting droplets of ink on demand from a free surface of a pool of liquid ink, comprising:

a solid substrate having a first surface with a plurality of essentially identical, generally spherically shaped indentations formed therein on predetermined centers to define an array of acoustic lenses and interstitial regions therebetween, and a second surface opposite said first surface;

piezoelectric transducer means intimately coupled to said second surface for generating rf acoustic waves to illuminate said lenses such that said lenses launch respective converging acoustic beams into said ink; and acoustically reflective means, intimately coupled to and substantially entirely coating said first surface except in the regions proximate said acoustic lenses to thereby define openings corresponding in position and size to each said acoustic lens, for reflecting said acoustic rf waves striking the upper surface of said substrate at the interstices between said acoustic lenses.

9. The printhead of claim 8, wherein said substrate has a first acoustic impedance and said acoustically reflective means has a second acoustic impedance greater than said first acoustic impedance.

10. The printhead of claim 9, wherein said piezoelectric transducer generates rf acoustic waves of a predetermined frequency and wavelength and further wherein said acoustically reflective means is of a thickness equal to an odd multiple of one quarter of the wavelength of a selected one of said generated rf acoustic waves.

11. The printhead of claim 9, wherein said piezoelectric transducer generates rf acoustic waves of a predetermined frequency and wavelength and further wherein said acoustically reflective means is of a thickness equal to one quarter of the wavelength of a selected one of said generated rf acoustic waves.

12. The printhead of claim 9, wherein said piezoelectric transducer generates rf acoustic waves within a broad bandwidth of frequencies and further wherein said acoustically reflective means is of a thickness equal to an odd multiple of one quarter of the wavelength corresponding to a selected one of said frequencies in said broad bandwidth.

13. The printhead of claim 9, wherein said acoustically reflective means is comprised substantially exclusively of gold.

14. In an acoustic printhead having at least one acoustic radiator for bringing an acoustic beam to focus essentially on a free surface of a pool of liquid such that said acoustic beam exerts a radiation pressure on said free surface, and modulating means coupled to said radiator for modulating said radiation pressure so as to eject individual droplets of liquid from said free surface on demand, the improvement comprising;

an isolation layer deposited on said printhead in facing relationship with respect to said free surface; said isolation layer being patterned to permit substantially unimpeded passage of said acoustic beam therethrough, but having an acoustic impedance selected to inhibit acoustic energy from coupling into said liquid peripherally of said acoustic beam.

* * * * *